United States Patent [19]

Landa et al.

[11] Patent Number: 4,768,060

[45] Date of Patent: Aug. 30, 1988

[54] PUSH-PULL LIQUID DEVELOPMENT METHOD AND APPARATUS

[75] Inventors: Benzion Landa, Edmonton, Canada; Yakov Krumberg, Rehovot, Israel

[73] Assignee: Savin Corporation, Stamford, Conn.

[21] Appl. No.: 22,246

[22] Filed: Mar. 5, 1987

[51] Int. Cl.[4] ..... G03G 15/10

[52] U.S. Cl. ..... 355/10; 355/3 R; 355/15

[58] Field of Search ..... 355/3 DD, 14 D, 15, 355/3 R; 430/48, 120

[56] References Cited

U.S. PATENT DOCUMENTS

| | | | |
|---|---|---|---|
| 4,264,185 | 4/1981 | Ohta | 355/10 X |
| 4,500,198 | 2/1985 | Daniels | 355/14 D |
| 4,588,285 | 5/1986 | Tagoku | 355/15 |
| 4,600,290 | 7/1986 | Ungemach | 355/3 DD |
| 4,607,940 | 8/1986 | Quang | 355/3 R |
| 4,669,859 | 6/1987 | Mochizuki et al. | 355/10 |

*Primary Examiner*—A. C. Prescott

*Attorney, Agent, or Firm*—Kenyon & Kenyon

[57] ABSTRACT

A method and apparatus capable of forming an image in an electrostatic apparatus having a photoconductor with a latent electrostatic image thereon. An electrical potential having a polarity opposite to the photoconductor is applied to a push development electrode thereby coating the image areas, as well as the background areas, of the latent electrostatic image. The background areas are cleaned by applying a potential having the same polarity as the photoconductor to a second pull development electrode.

3 Claims, 1 Drawing Sheet

PUSH-PULL LIQUID DEVELOPMENT METHOD AND APPARATUS

BACKGROUND OF THE INVENTION

This invention relates generally to improvements in an electrostatic apparatus, and more specifically, to improvements in the development stations of an electrostatic image-forming apparatus using liquid development toner and photoconductors which have low electrical potentials.

Electrostatic apparatuses of the prior art include a photoconductor and a development electrode. The photoconductor surface is able to receive and maintain a selectively positioned electrical charge for attracting and positioning toner particles. During the development process, an electrical potential is applied to the development electrode providing an electrical field between the photoconductor surface and the development electrode. This electrical field serves two functions: first, the electrical field urges toner toward the latent electrostatic image on the photoconductor; secondly, the electrical field urges toner from the non-image areas of the photoconductor toward the development electrode and thereby cleans the background (i.e. non-image) areas on the photoconductor. Development electrodes have achieved widespread acceptance in the industry because they provide a continuous, even coat of toner to the entire image area, including solid image areas.

In known copying machines, the copying cycle is started by the placement of a charge on the photoconductor surface. When a toner fluid having negatively charged particles is utilized, this initial charge usually has a potential of +1000 volts and can be as high as +1400 volts. A latent electrostatic image is formed on the photoconductor surface by one of several methods which can include exposing the initial charge to an image forming light source. The latent image area includes image portions which have the electrical potential of the initial charge and background or non-image portions which have a reduced electrical potential lower than that of the image areas.

The latent image on the photoconductor surface is passed in close proximity to the development electrode while toner fluid is pumped into the gap between the photoconductor surface and the development electrode. During this time, a low electrical potential having the same polarity as the photoconductor surface is applied to the development electrode. The potential applied to the development electrode is such that it creates an electrical field that enables the development of image areas and prevents the development of an image on the background areas. In a conventional electrostatic apparatus, when the image areas on the photoconductor surface have passed from the development electrode region, the polarity on the development electrode is reversed and the development electrode repels the charged toner particles deposited on the development electrode, thereby, pushing the toner particles back onto the photoconductor surface. The photoconductor surface is subsequently cleaned at a cleaning station located downstream with respect to the movement of the photoconductor surface.

The conventional systems employ photoconductors which must be maintained at high electrical potentials in order to provide clear copies at an acceptable rate.

OBJECTS OF THE INVENTION

It is therefore an object of the present invention to provide a copying machine capable of making high quality copies using low photoconductor potentials.

It is a further object of the present invention to provide an improved design for a copying machine by improving the development station to obtain a clearer copy image.

It is a further object of the present invention to provide a copying machine with an improved development electrode which can operate at high speeds using a photoconductor with a low voltage potential.

It is a further object of the present invention to provide a copying machine design which is capable of providing high quality copies using less expensive photoconductor material.

These and other objects of the present invention will become apparent from the following description and claims in conjunction with the drawings.

SUMMARY OF THE INVENTION

The present invention may be generally summarized as an improved development electrode arrangement for use in a copying machine which employs toner fluid having charged toner particles in combination with a latent electrostatic image. A push development electrode is provided with a voltage potential having a polarity opposite to the polarity of the photoconductor for enhancing the coating of the entire image area on the surface of the photoconductor. A relatively low electrical potential having the same polarity as the photoconductor is applied to a pull development electrode for attracting the charged toner particles away from background areas of the latent image.

BRIEF DESCRIPTION

FIG. 1 schematically illustrates one embodiment of the present invention.

FIG. 2 schematically illustrates a second embodiment of the present invention.

FIG. 3 schematically illustrates a third embodiment of the present invention.

DETAILED DESCRIPTION

Figure 1:
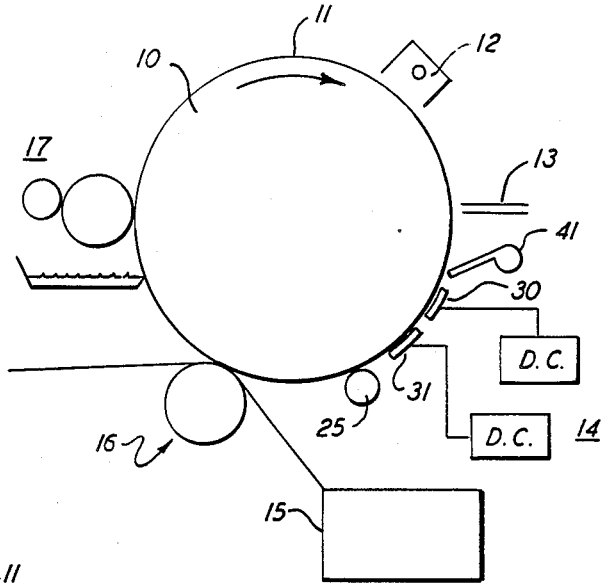

FIG. 1 illustrates one embodiment of the present invention wherein photoconductor drum 10 having photoconductor surface 11 is rotated in a clockwise direction. A charge is placed on photoconductor surface 11 by any suitable means at charging station 12. A latent image is formed on the charged photoconductor surface 11 at image forming station 13 by any suitable method, such as by exposing the charged photoconductor surface to a conventional light image-forming device.

As illustrated in FIG. 1, the developer station 14 of the present invention comprises two "flat" (actually curved) development electrodes, a push development electrode 30 and a pull development electrode 31. A pump 41 supplies charged toner liquid to the gap between photoconductor drum 10 and push development electrode 30. Push electrode 30 is supplied with an electrical potential which has a polarity opposite to the polarity of the photoconductor. The electrical potential applied to development electrode 30 therefore enhances the electrical field between the photoconductor 10 and the push development electrode 30. The potential of push electrode 30 is sufficient to coat both the image areas and non-image areas of the photoconductor surface 11.

Pull development electrode 31, located downstream of push development electrode 30, is supplied with a relatively low electrical potential having the same polarity as the photoconductor 10. The low potential of the pull development electrode 31 is set high enough that charged toner particles are attracted away from the background areas on the photoconductor 10 but is sufficiently low such that most of the charged toner particles in the image areas remain in place.

As shown in FIG. 1, a metering roller 25 is positioned adjacent to photoconductor drum 10 and downstream of pull development electrode 31. The gap between metering roller 25 and photoconductor drum surface 11 is between about 50 and 60 microns but can be larger or smaller as will be appreciated by those skilled in the art. The potential of the pull development electrode 31 need only be sufficient to attract the charged toner particles a relatively short distance from the photoconductor surface so that those particles can be removed by metering roller 25.

It will be appreciated by those skilled in the art that the optimum electrical potentials supplied to the push electrode 30 and pull electrode 31 will be dependent on numerous other parameters of the electrostatic apparatus such as the initial potential placed on the photoconductor surface, the size of the respective gaps between the photoconductor surface and the push electrode and pull electrode, the respective lengths of the electrode, and the speed of the photoconductor surface.

The developed image is transferred to a blank sheet from paper supply 15 at transfer station 16. Residual toner remaining on the photoconductor 10 is removed at cleaning station 17.

Figure 2:
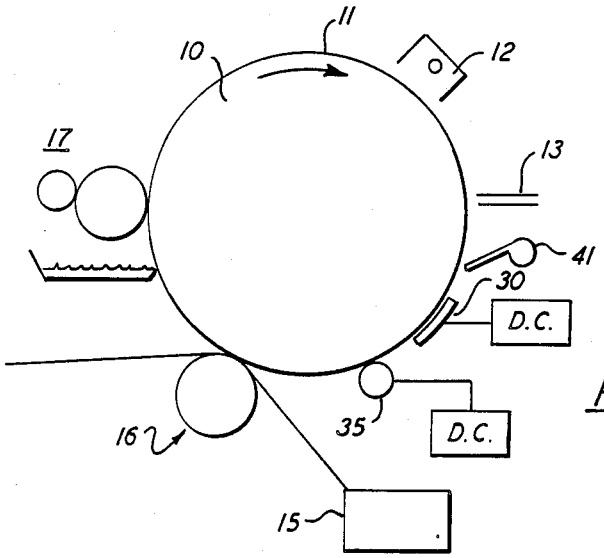

In a second embodiment of the present invention, as illustrated in FIG. 2, the function of the previously described pull electrode 31 is performed by a biased metering roller electrode 35. A low electrical potential having the same polarity as the photoconductor is applied to biased metering roller electrode 35. In this fashion, charged toner particles in the background areas on the photoconductor surface are urged toward the surface of the rotating biased metering roller 35 where the toner particles will be mechanically removed. This embodiment provides a pull electrode which is easier to clean than the "flat" electrode described above.

Figure 3:
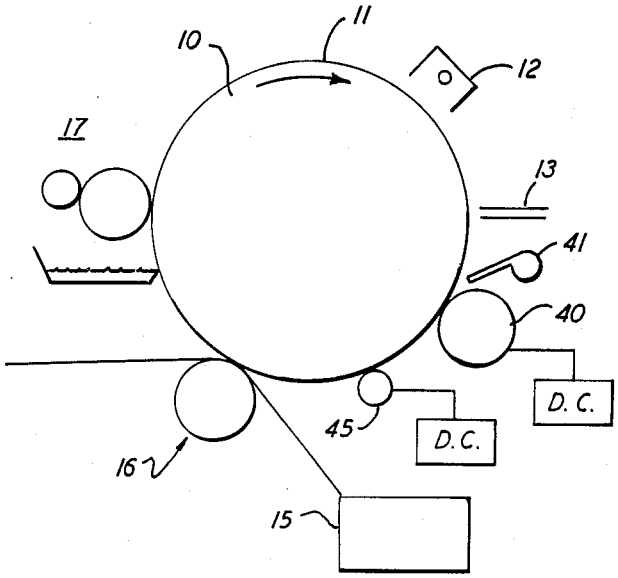

In a third embodiment of the present invention, as shown in FIG. 3, a development roller electrode 40 is supplied with an electrical potential having a polarity opposite to the polarity of the photoconductor and sufficient to coat the entire image area. A biased metering roller 45 is supplied with an electrical potential and functions similar to biased metering roller 35 described above. It will be appreciated by those skilled in the art, that by applying an electrical potential having a polarity opposite to the polarity of the photoconductor, this embodiment as well as all embodiments within the scope of the present invention, provide a method and apparatus capable of achieving high quality images with a low photoconductor potential.

As stated above, the electrical potential supplied to the push electrode and pull electrode of the present invention will be dependent on several parameters of the electrostatic apparatus with which this invention is to be utilized. Further appreciation of the present invention will be provided by the following non-limiting example.

EXAMPLE

A latent image was formed on a photoconductor drum surface moving at a speed of 250 mm/sec and having a +400 volt charge. The toner fluid utilized had negatively charged toner particles, a solids concentration of 1.5% and a conductivity of 20 p $cm^{-1}$. A voltage of −250 volts was applied to a "flat" (curved) push electrode having a length of 100 mm, positioned 0.6 mm from the photoconductor surface. A biased metering roller electrc,de was positioned 50 miorons from the surface of the photoconductor drum. As such a metering roller would normally carry a "floated" bias such as +150 volts induced from the potential of the photoconductor, an additional +100 volts was applied to the metering roller to bring the potential of the metering roller to +250 volts.

Even at the low photoconductor potential of +400 volts, acceptable copies were made at a rate of 30 copies per minute.

The foregoing example is illustrative of the desirable results obtainable with the present invention.

While the present invention has been illustrated with a photoconductor drum, it will be appreciated by those skilled in the art that the advantages of the present invention will be realized with photoconductors having other configurations.

We claim:

1. An electrostatic apparatus for forming an image having a photoconductor, a push development electrode and a pull development electrode, wherein said photoconductor has a charge having a polarity, means for applying an electrical potential to said push electrode, wherein an electrical potential having a polarity opposite to said polarity of said photoconductor charge is applied to said push development electrode.

2. An electrostatic apparatus as in claim 1 further comprising:

means for supplying an electrical potential to said push development electrode and wherein an electrical potential having the same polarity as said photoconductor charge is applied to said pull development electrode.

3. A method of developing a latent electrostatic image in an electrostatic apparatus comprising a photoconductor having a charge, said photoconductor charge having a polarity, a push development electrode, a pull development electrode, and means for supplying electrical potentials to said push development electrode and said pull development electrode, comprising the steps of:

applying an electrical potential having a polarity opposite to the polarity of said photoconductor to said push development electrode; and applying an electrical potential having the same polarity as said photoconductor to said pull electrode.

* * * * *

UNITED STATES PATENT AND TRADEMARK OFFICE

CERTIFICATE OF CORRECTION

PATENT NO. : 4,768,060

DATED : August 30, 1988

INVENTOR(S) : Benzion Landa and Yakov Krumberg

It is certified that error appears in the above-identified patent and that said Letters Patent is hereby corrected as shown below:

| Column | Line | |
|---|---|---|
| 1 | 40 | Please delete "1ight" and insert --light--. |
| 4 | 16 | Please delete "electrc,de" and insert --electrode--. |
| 4 | 16 | Please delete "miorons" and insert --microns--. |

Signed and Sealed this

Seventeenth Day of January, 1989

*Attest:*

DONALD J. QUIGG

*Attesting Officer*

*Commissioner of Patents and Trademarks*